United States Patent [19]

Trimble

[11] Patent Number: 4,809,985

[45] Date of Patent: Mar. 7, 1989

[54] GOLF GAME AND METHOD FOR PLAYING A GOLF GAME

[76] Inventor: Harold J. Trimble, Box 72-7151 W. Hwy. 98, Panama City Beach, Fla. 32407

[21] Appl. No.: 12,278

[22] Filed: Feb. 9, 1987

[51] Int. Cl.[4] ..... A63F 3/00

[52] U.S. Cl. ..... 273/245

[58] Field of Search ..... 273/245, 87 R

[56] References Cited

U.S. PATENT DOCUMENTS

| | | | |
|---|---|---|---|
| 1,520,081 | 12/1924 | Purnell | 273/245 |
| 4,277,065 | 7/1981 | White | 273/245 |
| 4,380,338 | 4/1983 | Lacy | 273/245 |

*Primary Examiner*—Richard C. Pinkham
*Assistant Examiner*—Benjamin Layno
*Attorney, Agent, or Firm*—John Wade Carpenter

[57] ABSTRACT

A golf game having at least one game board carrying a pictorial configuration of a multi-hole golf course including appropriate pictorial representations of a tee, a green with a boundary and distant from the tee, a hole on each green, a fairway generally extending between the tee and the green, and a plurality of hazards positioned adjacent to the fairway and to the green. At least one ball marker is provided to signify a golf ball of a player and adapted to be moved and positioned on the game board by a player after a golf shot. A plurality of dice, matrix type schedules, and distance/direction guages are used to determine where golf shots come to rest. A method for playing a golf game which includes selecting a golf club and manipulating simultaneously a six-sided die and a twelve-sided die in order to randomly generate a pair of numbers that are used to determine the distance and direction of a golf shot from a pair of matrix type schedules. The method for playing a golf game additionally comprises plotting each golf shot.

20 Claims, 5 Drawing Sheets

FIG. 5
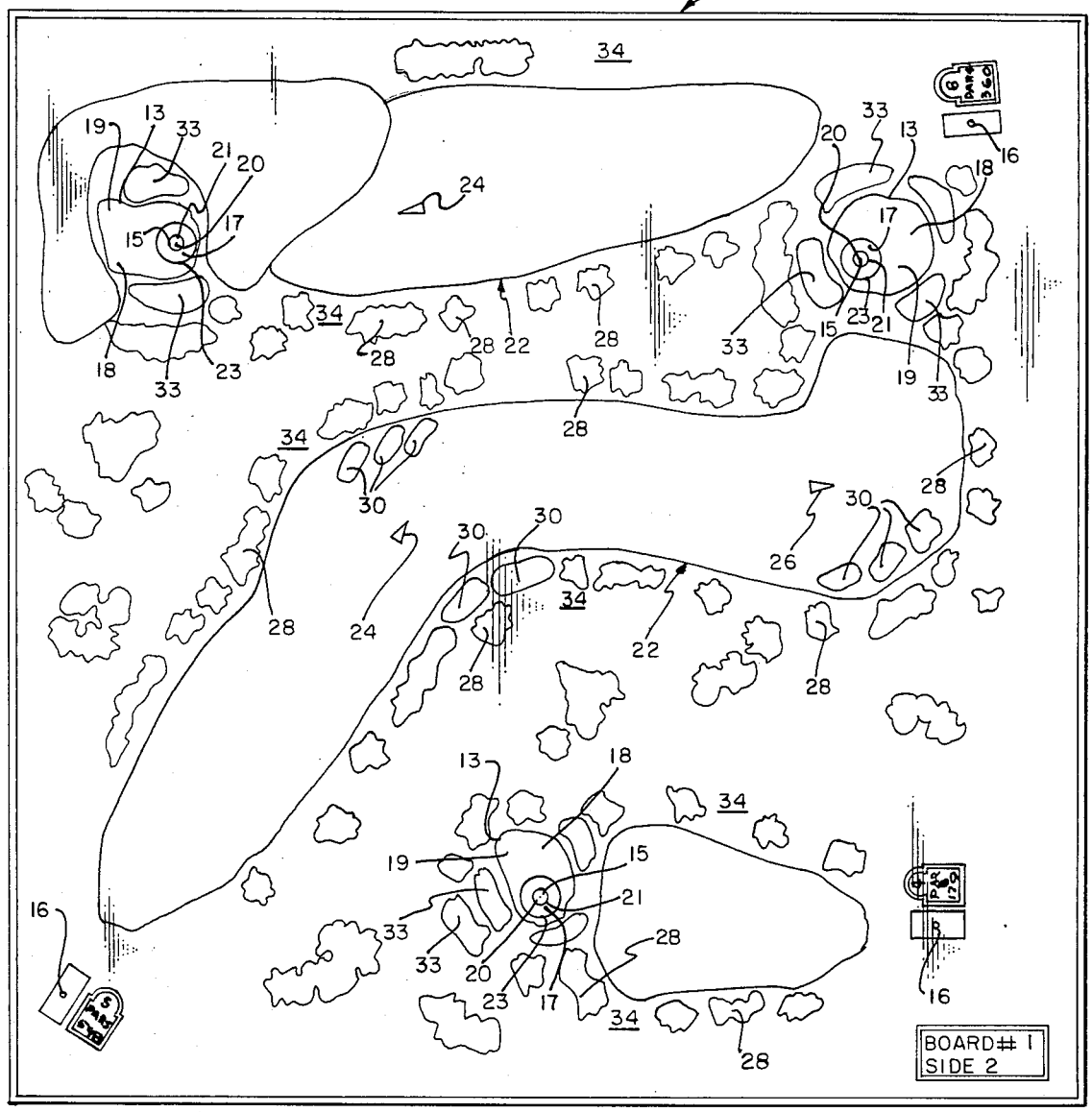
FIG. 6
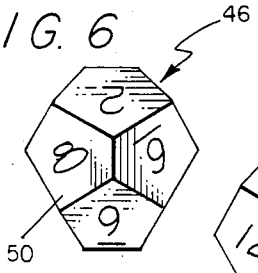
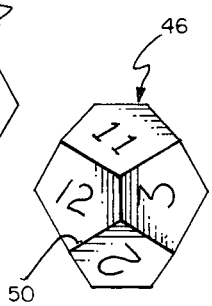
FIG. 7
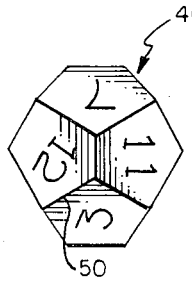
FIG. 8
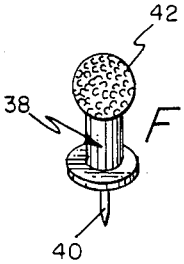
FIG. 9

FIG. 10
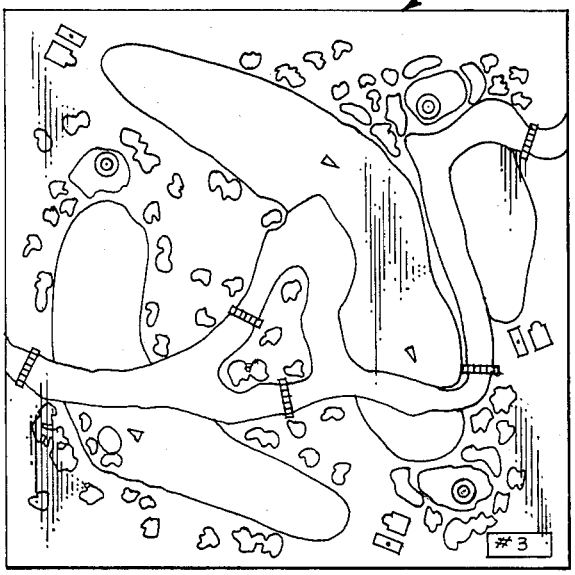
FIG. 11
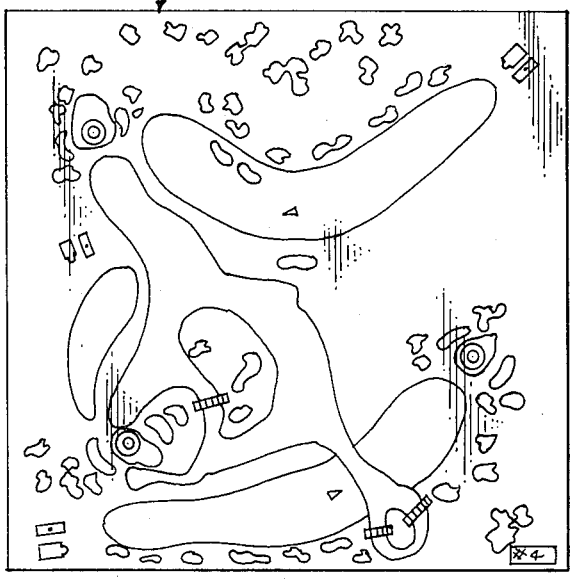
FIG. 12
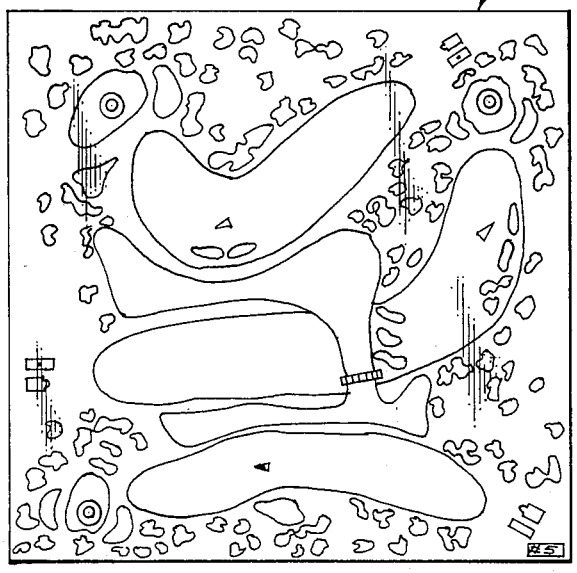
FIG. 13
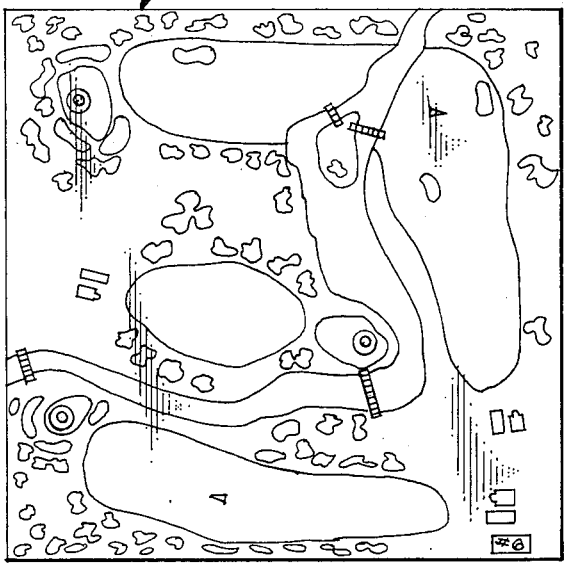
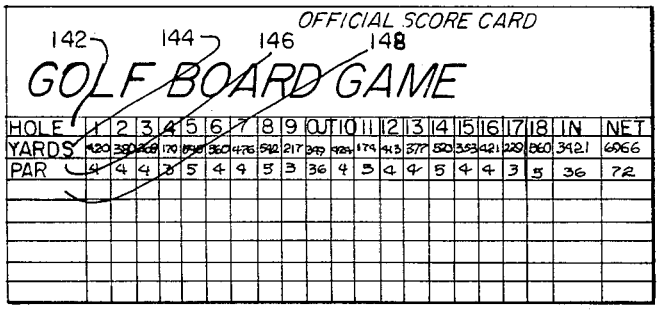
FIG. 14

SCHEDULE FOR GREEN DISTANCE DICE IN YARDS

| NUMBER ROLLED | WOOD SHOTS 1 | 3 | 5 | IRON SHOTS 3 | 4 | 5 | 6 | 7 | 8 | 9 | PITCHING ORDER | SAND WEDGE | PITCH/CHIP SHOTS LONG | MED. | SHORT |
|---|---|---|---|---|---|---|---|---|---|---|---|---|---|---|---|
| 1 | 230 | 210 | 190 | 180 | 165 | 150 | 140 | 130 | 120 | 110 | 90 | 70 | 45 | 30 | 15 |
| 2 | 240 | 220 | 200 | 185 | 170 | 155 | 145 | 135 | 125 | 105 | 95 | 75 | 50 | 35 | 20 |
| 3 | 250 | 225 | 205 | 190 | 175 | 160 | 150 | 140 | 130 | 110 | 100 | 80 | 55 | 40 | 25 |
| 4 | 260 | 230 | 210 | 195 | 180 | 165 | 155 | 145 | 135 | 115 | 105 | 85 | 60 | 45 | 30 |
| 5 | 270 | 235 | 215 | 200 | 185 | 170 | 160 | 150 | 140 | 120 | 110 | 90 | 65 | 50 | 35 |
| 6 | 280 | 245 | 225 | 205 | 190 | 175 | 165 | 155 | 145 | 125 | 115 | 95 | 70 | 55 | 40 |

SCHEDULE FOR GREEN DIRECTION DICE

| NUMBER ROLLED | DIRECTION |
|---|---|
| 1 | STRAIGHT SHOT |
| 2 | 10° DEGREES RIGHT |
| 3 | 10° DEGREES LEFT |
| 4 | STRAIGHT SHOT |
| 5 | 20° DEGREES RIGHT |
| 6 | STRAIGHT SHOT ADD 5 YDS ON WOOD |
| 7 | 20° LEFT |
| 8 | STRAIGHT SHOT |
| 9 | STRAIGHT SHOT-LOSE 10 YDS ON 3 IRON THRU SAND WEDGE SHOTS |
| 10 | 10° DEGREES LEFT |
| 11 | 10° DEGREES RIGHT |
| 12 | STRAIGHT SHOT "HOLED" |

SCHEDULE FOR RED PROBLEM DICE

| NUMBER ROLLED | IN THE ROUGH | IN FAIRWAY SAND TRAP | BEHIND A TREE | UNDER A TREE |
|---|---|---|---|---|
| 1 | LOSE 10 YDS | CLEAN SHOT | LOSE 1/2 DIST. | LOSE 15 YDS. |
| 2 | GAIN 15 YDS | LOSE 20 YDS | CLEAN SHOT | LOSE 1/2 DIST. |
| 3 | CLEAN SHOT | LOSE 10 YDS | LOSE 20 YDS | CLEAN SHOT |
| 4 | GAIN 5 YDS | CLEAN SHOT | CLEAN SHOT | LOSE 40 YDS |
| 5 | CLEAN SHOT | LOSE 50 YDS | LOSE 30 YDS | CLEAN SHOT |
| 6 | LOSE 15 YDS | LOSE 25 YDS | CLEAN SHOT | LOSE 30 YDS |

SCHEDULE FOR GREENSIDE TRAP SHOTS & PUTTS

| NUMBER ROLLED | GREENSIDE SAND TRAP | LONG PUTTS | SHORT PUTTS |
|---|---|---|---|
| 1 | TO LONG PUTT | 2 PUTTS | 1 PUTT |
| 2 | TO SHORT PUTT | 3 PUTTS | 2 PUTTS |
| 3 | TO GIMME PUTT | 1 PUTT | 1 PUTT |
| 4 | STUCK IN TRAP | 3 PUTTS | 1 PUTT |
| 5 | TO LONG PUTT AR | 3 PUTTS | 1 PUTT |
| 6 | TO SHORT PUTT" | 2 PUTTS | 2 PUTTS |

GOLF BOARD GAME

FIG. 15

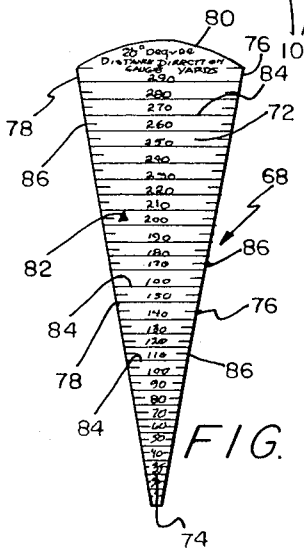

FIG. 16

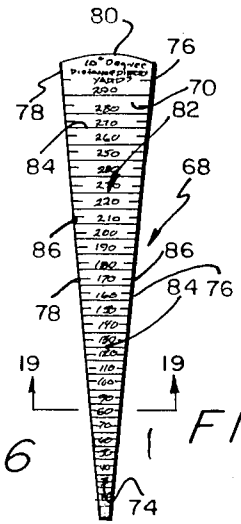

FIG. 17

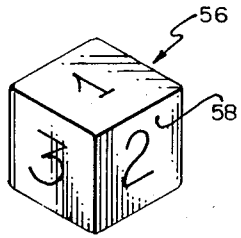

FIG. 18

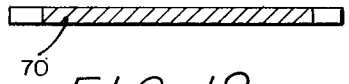

FIG. 19

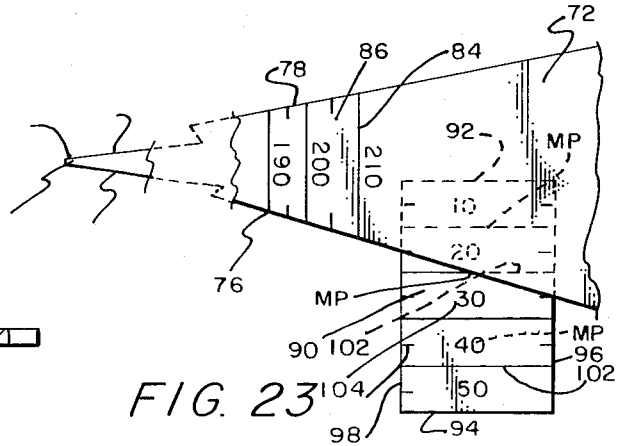

FIG. 23

FIG. 20
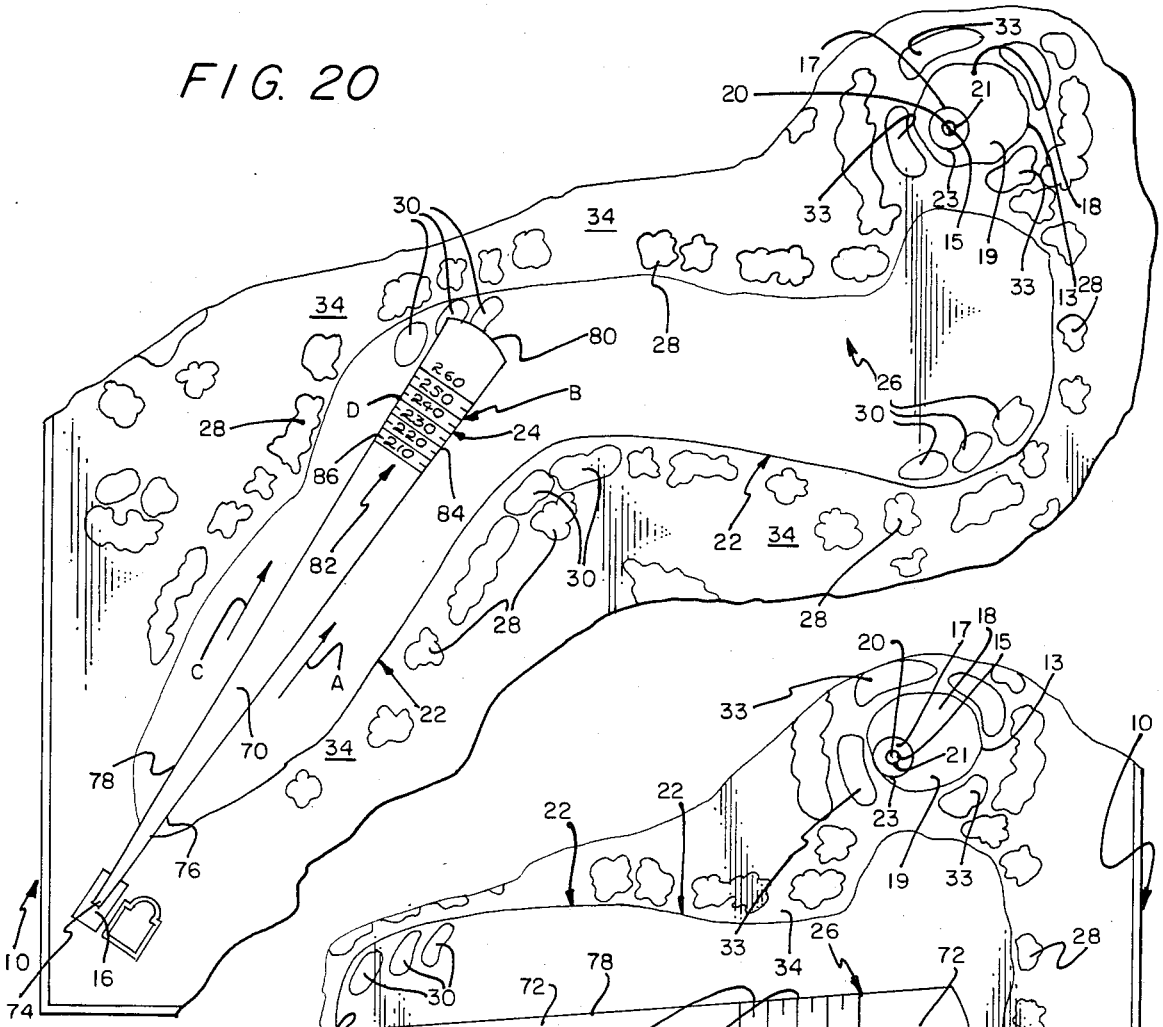
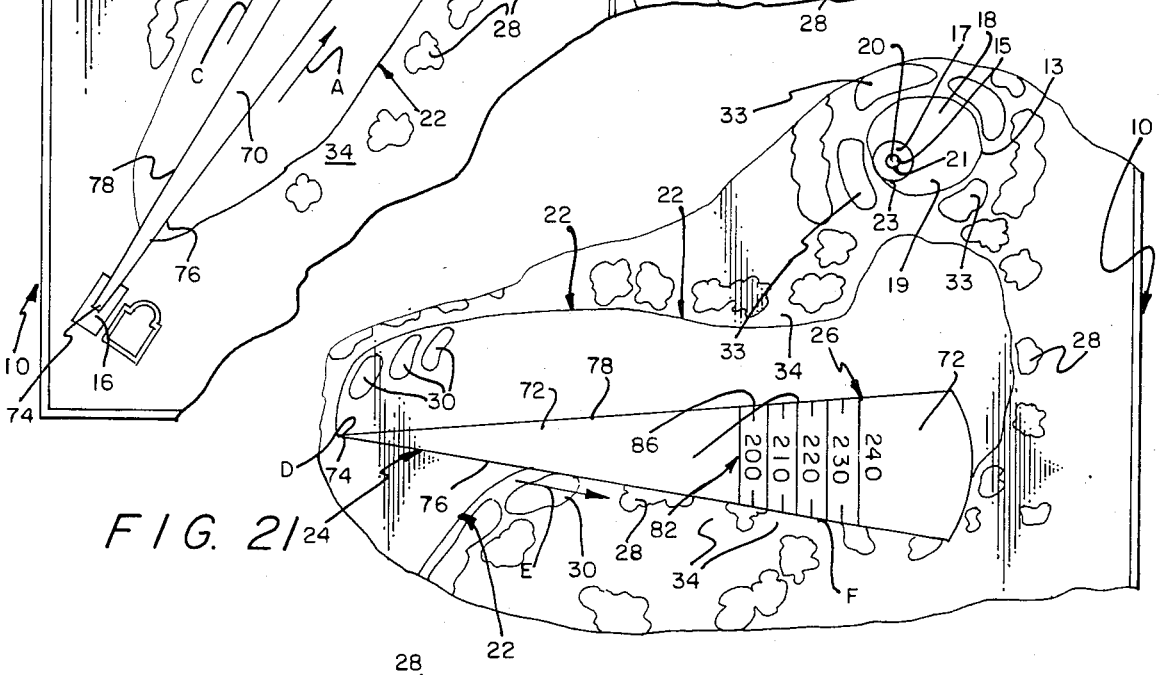
FIG. 21
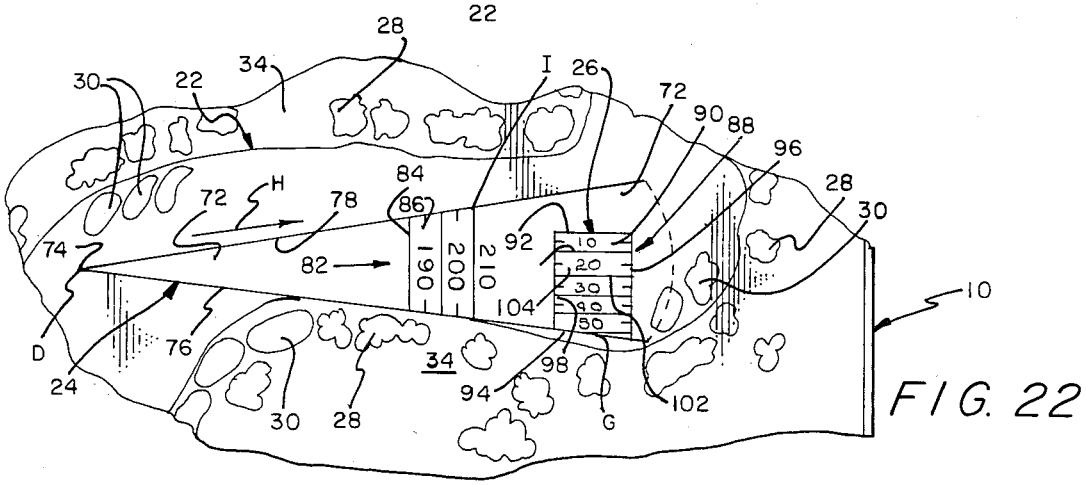
FIG. 22

GOLF GAME AND METHOD FOR PLAYING A GOLF GAME

BACKGROUND OF THE INVENTION

1. Field of the Invention

The invention relates to a golf game. More particularly, this invention relates to a golf game for participation by one or more players and to a method for playing a golf game 2. Description of the Prior Art Many attempts have been made at inventing a golf board game that would be easy to understand, simple to play, while still be realistic and challenging as is actual golf. An ideal game would have features and characteristics that allows a player to make the same type mental decisions regarding club selection, where direction shots are aimed, when to take risk or when to play conservative, etc.

There are many golf board games known in the prior art, including those disclosed in the following U.S. Pats. Nos.: 1,605,739; 1,615,982; 1,638,365; 1,758,581; 3,260,526; 3,410,561; 3,910,581; 4,113,260; 4,134,590; 4,364,569; and 4,380,338. The golf board games of these prior art U. S. Patents utilize various type random number selection devices, simple to extremely complicated charts and schedules, and board layouts ranging from one hole per board up to 18 holes on a single board. Many distracting lines, numbers and unusual features are incorporated in the design of some of these prior art U. S. Patents, such as U.S. Pat. No. 3,910,581 to Nicholson, U.S. Pat. No. 4,113,260 to Sain, U.S. Pat. No. 4,134,590 to Conrad, U.S. Pat. NO. 4,364,569 to Duwell et al., and U.S. Pat. No. 4,380,338 by Lacy. Also, the manner in which golf shots are determined in these prior art U. S. Patents are either too simplistic to result in a game a golfer would find interesting, or too complicated by the requirement of having to manipulate too many cards or charts. Several of these prior art U. S. Patents have attempted to turn a course layout designed for the outdoor game of gold into a golf board game with mediocre results. Therefore, what is needed and what has been invented by me is a realistic and challenging golf board game that is easy to understand, simple to play, and can be enjoyed by golf enthusiasts of all skill levels.

SUMMARY OF THE INVENTION

This invention accomplishes its desired objects by broadly providing a golf game that comprises at least one game board means carrying a pictorial configuration of a multi-hole golf course. The pictorial configuration includes appropriate pictorial representations of a tee, a green with a boundary and distant from the tee, a hole on each green, a fairway generally extending between the tee and the green, and a plurality of hazards positioned adjacent to the fairway into the green. The golf game includes at least one ball marker means signifying a golf ball of a player and adapted to be moved and positioned on the game board by a player after a golf shot. A first chance means is provided for manipulation by a player for randomly generating a number. Also provided is a first source of information means including a plurality of sets of first number indicia thereon relating to each of a plurality of clubs arbitrarily chosen by player prior to manipulation of the first chance means. The first number indicia of each of the sets represents a length of travel of a player's golf ball when using a particular club according to a number generated by the first chance means. The golf game also includes a second chance means for manipulation by a player for randomly generating a second number, and a second source of information means which comprises direction indicia for signifying the direction of travel of the player's golf ball according to the number generated in response to manipulation of the second chance means. At least one direction and distance marking means is available for facilitating the plotting of a golf shot with the ball marker means from the length of travel of a player's golf ball according to the first number indicia obtained from the first source of information means and from the direction of travel of the player's golf ball according to direction indicia obtained from the second source of information means.

The present invention also accomplished its desired objects by providing a method for playing a golf game with the at least one gam board means. The method broadly comprises selecting a golf club in order to undertake a golf shot from a predetermined location, and manipulating simultaneously the first chance means for randomly generating a first number that is used to determine the distance of the golf shot and a second chance means for randomly generating a second number which is used to determine the direction of the golf shot. The distance of the golf shot is determined from the first source of information means according to the golf club selected and the first number generated by the first chance means. The direction of the golf shot is determined from a second source of information means according to the second number generated by the second chance means. After the distance and direction of the golf shot is determined, the method for playing the golf game additionally comprises plotting the golf shot. The at least one direction and distance marking means is utilized in the plotting of the golf shot. In the event that the golf shot is plotted in one of the problem conditions as disclosed herein, the method for playing a golf game additionally comprises manipulating a third chance means simultaneously with the first chance means and the second chance means in order to randomly generate a third number. This third number may be used to determine the distance of travel of the golf shot from the problem condition by a third source of information means. After the golf ball reaches a green, the first chance means is again manipulated solely or alone in order to determine the number of putts required to putt the golf ball in the hole on the green. The number generated from the first chance means in combination with a fourth source of information means is used to make such a determination.

It is therefore an object of this invention to provide a golf game.

It is another object of this invention to provide a method for playing a golf game.

These, together, with the various ancillary objects and features which will become apparent as the following description procedes, are attained by this invention, preferred embodiments being shown in the accompanying drawings, by way of example only, wherein:

BRIEF DESCRIPTION OF THE DRAWINGS

FIG. 5 is a top plan view of the opposite side of the game board of FIG. 1 and discloses typical golf holes #s 4, 5 and 6 of the golf game of this invention;

FIG. 6 is a perspective view of one side of the second chance means or a twelve-sided die;

FIG. 7 is another perspective view of another side of the twelve-sided die of FIG. 6;

FIG. 8 is yet another perspective view of yet another side of the twelve-sided die of FIG. 6;

FIG. 9 is a perspective view of the ball marker means which may be used to mark the location of a player's golf ball after a golf shot;

FIG. 10 is a top plan view of one side of another of the three typical game boards;

FIG. 11 is a top plan view of the other side of game board in FIG. 10;

FIG. 12 is a top plan view of one side of yet another of the three typical game boards;

FIG. 13 is a top plan view of the other side of the typical game board of FIG. 12;

FIG. 14 is a top plan view of an official score card for the golf game;

FIG. 15 is a top plan view for the SCHEDULE FOR GREEN DISTANCE DIE IN YARDS, SCHEDULE FOR GREEN DIRECTION DIE, SCHEDULE FOR RED PROBLEM DIE, and SCHEDULE FOR GREENSIDE TRAPSHOTS AND PUTTS;

FIG. 16 is a top plan view of the 20 degree distance/-direction gauge;

FIG. 17 is a top plan view of the 10 degree distance/-direction gauge;

FIG. 18 is a perspective view of the fourth chance means or a six-sided die;

FIG. 19 is a vertical sectional view taken in direction of the arrows and along the plane of line 19-19 in FIG. 17;

FIG. 20 is a partial top plan view of hole #5 of the typical game board in FIG. 5 disclosing the manner the 10 degree distance/direction gauge is employed to plot a golf shot of a certain distance and direction from the tee;

FIG. 21 is a partial top plan view of hole #5 in FIG. 5 and FIG. 20 disclosing the 20 degree distance/direction gauge employed to plot a second golf shot taken from the point where the first golf shot landed in FIG. 20 at a certain distance and direction from the point;

FIG. 22 is a partial top plan view of the hole #5 in FIGS. 5, 20 and 21 disclosing the use of the distance marking means and the 20 degree direction/distance gauge means in plotting a second golf shot that was taken from the point in FIG. 20 and aimed at a predetermined distance to the right of a direction marker; and FIG. 23 is an exploded, partial top plan view of the 20 degree/distance gauge superimposed over the thin sheet member of FIG. 2 such that the apex of the 20 degree/distance gauge is registered with point D of FIGS. 20, 21 and 22 and a side is aligned with and passes through the mid-point of the 20 yard line of the thin sheet member.

DETAILED DESCRIPTION OF THE INVENTION

Figure 1:
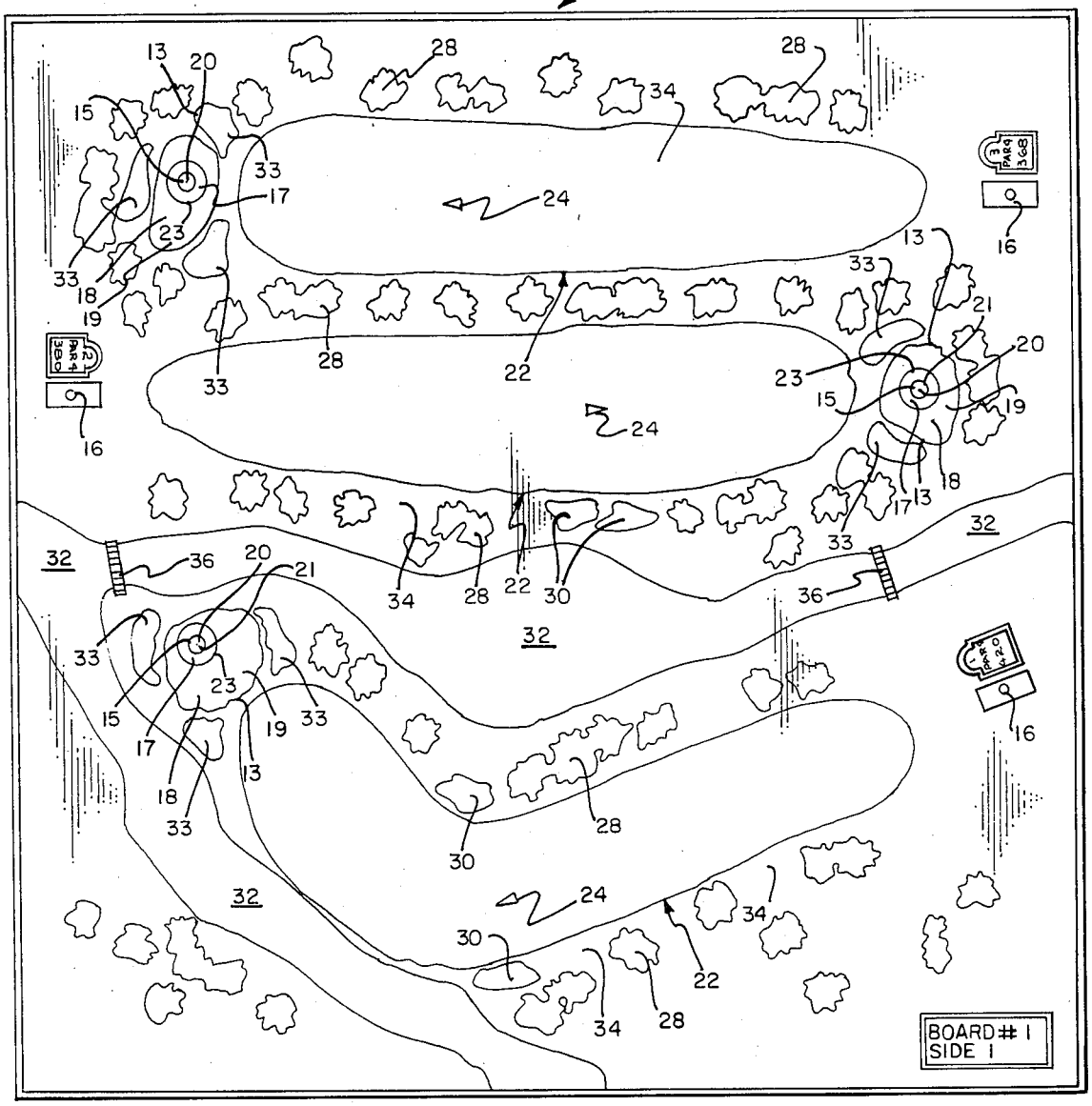
FIG. 1 is a top plan view of one side of one of the three game boards and discloses typical golf holes #s 1, 2 and 3 of the golf game of this invention.

Referring in detail now to the drawings for a description of the golf game of this invention, there is seen three double-sided boards which have been respectively designated 10, 12 and 14. Each side of boards 10, 12 and 14 contains three golf holes such that the three double-sided boards 10, 12 and 14 contain eighteen golf holes. FIG. 1 and FIG. 5 represents golf holes 1, 2, 3, 4, 5 and 6 are are exemplary of the remaining twelve golf holes which are illustrated in FIGS. 10–13.

The golf holes 1, 2, 3, 4, 5 and 6 displayed or carried on board 10 in FIGS. 1 and 5 contain appropriate pictorial representation of a tee 16, a green 18 having a border, confine or boundary 13 and distant from the tee 16, a hole (pin) 20 on each green 18, and a fairway 22 generally extending between the tee 16 and the green 18. Each green 18 has a "gimme putt" area 15, a short-putt area 17 and a long-putt area 19, all pictorially represented thereon. The "gimme putt" area 15 may be defined as an area of a first circle 21 that is pictorially represented on each green 18 such as to be centered on each hole (pin) 20. The next golf shot after or following a golf shot that has landed in the "gimme putt" area 15 is a "gimme putt" or one stroke added to the number of golf strokes already taken on a particular hole. The short-putt area 17 may be defined as an area outside the first circle 21 and within a second circle 23 that is pictorially represented on each green 18 such as to be centered by each hole (pin) 20 and concentric with the first circle 21. The long-putt area 19 may be defined as an area outside the second circle 23 and within the border, confines or boundary 13 of the green 18.

The fairways 22 for all par 4 and par 5 holes, such as golf holes #s 1, 2, 3, and 5 (see FIGS. 5 and 10), have a direction marker 24 disposed in the fairways 22 distant from the tee 16. The fairways 22 for all par 5 holes, such as golf hole #5 in FIG. 5, have a direction marker 26 that is disposed in the fairway 22 between direction marker 24 and the green 18. Throughout this specification, it should be understood that reference in general terms to elements appearing on the same board 10 would also be taken to mean similar elements on game boards 12 and 14, unless specific elements are called out below for purposes of explanation in specific instances.

The game boards 10, 12 and 14 also present appropriate pictorial representation of a plurality of problems or hazards, such as trees 28, sand traps 30 along or in the fairways 22, water 32 contiguous to the fairways 22 and the greens 18, sand trap 33 along with the side of greens 18, and rough 34 which is anywhere outside the dark outline of the fairway 22 including any islands. Hazardous water 32 is crossed by golf players with the assistance of bridges 36. Trees 28 create two particular problems or hazards for a player: the player's golf ball lands behind a tree 28 or under a tree 28, both of which will be further discussed below. Notwithstanding the particular problems or hazards represented by trees 28, and traps 30 and 33, water 32, and rough 34, it should be understood that the golf game boards 10, 12 and 14 for the golf game of this invention may comprise additional problems or hazards which have not been specifically identified with a reference numeral. These additional problems or hazards are of a large variety of forms typical of those normally encountered on a regular golf course including woods, lumbers, lost ball, embedded ball, brush, grass of varied lengths, fringe of green, out of bounds, etc., and all are within the spirit and scope of this invention.

At least one ball marker, generally illustrated as 38, is utilized in the play of the game. As illustrated in FIG. 9, the ball marker 38 comprises a pin 40 with a mounted head 42. The pin 40 pierces and locks into the game boards 10, 12 and 14 at the location where the player's ball rests in order to mark the location of the same. Thus, ball marker 38 signifies a golf ball of a player and is adapted to be moved and positioned on the game boards 10, 12 and 14 by a player after a golf shot. Ball marker 38 is merely representative of any marker means that falls within the spirit and scope of this invention and which may be employed to plot the position or location of a player's golf ball on the game boards 10, 12 and 14.

Figure 3:
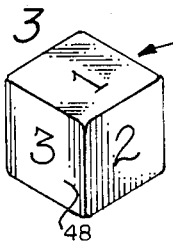
FIG. 3 is a perspective view of a first chance means or a six-sided die.
Figure 4:
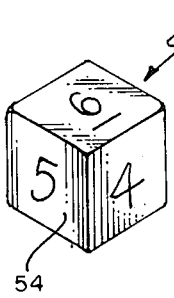
FIG. 4 is a perspective view of a third chance means or a six-sided die.

Turning briefly now to FIGS. 3, 4, 6, 7, 8 and 18, first chance means 44 is provided for manipulation by a player. A second chance means 46 is also provided for manipulation by a player. As illustrated, first change means 44 and second chance means 46 are in the form of die 48 and die 50, respectively, preferably uniform in color, such as green. Die 48 is a conventional six-sided die whose sides are numbered, respectively, one through six (see. FIG. 3). Die 50 has at least seven sides; up to twenty four sides; more preferably die 50 is a twelve-sided die whose sides are numbered, respectively, on through twelve (see FIGS. 6–8). FIG. 4 discloses a third chance means 52 which is also for manipulation by a player. Third chance means 52 is preferably in the form of a die 54 and is preferably of a color (e.g. red) that is different than dice 48 and 50. Die 54 is a conventional six-sided die whose sides are numbered, respectively, one through six (see FIG. 4). In a further embodiment to the present invention, a fourth chance means 56 is further also provided for manipulation by a player. As illustrated in FIG. 18, fourth chance means 56 is in the form of a die 58, which may be of any color. Die 58 is a conventional six-sided die whose sides are numbered, respectively, one through six. Because the fourth chance means 56 or die 58 is manipulated singularly and not simultaneously with the first, second, and third chance means 44, 46, and 52, respectively or dice 48, 50, and 54, respectively (as will be further discussed in greater detail below), fourth chance means 56 or die 58 is not necessary in the game of this invention, and may be replaced by or substituted with the first chance means 44 or die 48, or the third chance means 52 or die 54. Dice 48, 54 and 58 are all six-sided dice whose sides are numbered, respectively, one through six. In a preferred embodiment of the invention, die 58 is green and is preferably therefore replaced by or substituted with the die 48 which is also preferably green. As a matter of economics for cutting costs in manufacturing the golf game of this invention, die 58 (or fourth chance means 56) is omitted and when the time comes in playing the golf game to manipulate die 58, die 48 (or first chance means 44) is manipulated in place of die 58.

Although dice 48, 50, 54 and 58 have been illustrated in the drawings and are referred to in this disclosure, it should be understood that the invention is not to be limited to the use of dice for randomly generating the preferred numbers. Indeed, any suitable mechanism or device for randomly generating the preferred numbers of the quality to be described can be utilized in playing the game and should be considered to be within the spirit and scope of the invention. Thus, the random number generator may be spinners (as described in U.S. Pat. Nos. 4,113,260 and 4,134,590) or any other random number generator and would still be encompassed by the present invention.

With reference now to FIG. 15, a first source of information means, also referred to SCHEDULE FOR GREEN DISTANCE DIE IN YARDS, is provided and is generally illustrated as 60. First source of information 60 includes a plurality of separate sets of first number indicia, each set generally illustrated as 62 and is preferably in column form as seen in FIG. 15. The plurality of separate sets of first number indicia 62 relate to each of a plurality of clubs (i.e., #1 wood, #3 iron, sand wedge, etc.) as arbitrarily chosen by a player prior to rolling the dice 48 and 50, and also die 54 if a problem or hazardous condition has been presented (as further discussed below). As illustrated in FIG. 15, respective clubs precede the separate sets of first number indicia 62 which represents the length or distance of travel of a player's golf ball when using a particular club according to a number generated by the first chance means 44 or die 48 in response to manipulating the first chance means 44 or tossing the die 48. Thus, by way of example, if a player elects to use a six-iron for a golf shot and the number rolled by the player with die 48 is "2", the distance of the six-iron shot is 145 yards. Thus, the 145 yards represent the distance in yards the golf ball travels with the six-iron in response to the toss of the die 48. The particular manner of measuring the 45 yards from the point of the six-iron golf shot on the game boards 10, 12 and 14 will be explained below.

Referring again now to FIG. 15, a second source of information, also referred to as SCHEDULE FOR GREEN DIRECTION DIE, is generally indicated by reference number 64. Second source of information 64 comprises direction indicia, generally illustrated as 66, which is preferably in column formation as illustrated in FIG. 15. Direction indicia 66 comprise twelve possible directions for a player's golf ball to travel from the point of shot and signifies the direction of travel of a player's golf ball in response to manipulation of the second chance means 46 which, as indicated, is preferably the twelve-sided die 50. Thus, if the number "5" is shown on the twelve-sided die 50 after being tossed, the direction of the golf shot from the direction indicia 66 is "20 degrees right" as can be seen in FIG. 15. The particular manner of measuring the direction of a golf shot from the point of the golf shot on the game boards 10, 12 and 14 will be explained below.

The direction of the golf shot is determined simultaneously with determining the distance of the golf shot. Therefore, dice 48 and 50 are rolled simultaneously in order to randomly generate simultaneously a number from die 48 and a number from die 50. As was previously mentioned, from the number generated by die 48 the distance of the golf shot may be determined from SCHEDULE FOR GREEN DISTANCE DIE IN YARDS 60, and from the number generated by die 50 the direction of the gold shot may be determined from SCHEDULE FOR GREEN DIRECTION DIE 64. Thus, by way of example only, if a player selects a nine-iron for an approach shot to one of the greens 18 and subsequently, simultaneously rolls the number "1" on die 48 and the number "10" on die 50, the nine-iron shot traveled 100 yards (as determined from the SCHEDULE FOR GREEN DISTANCE DIE IN YARDS 60) at a direction of 10 degrees left (as determined by SCHEDULE FOR GREEN DIRECTION DIE 64). The direction of the golf shot is measured from the point of aim, which for the purposes of this invention is from one of the direction markers 24 or 26, or the hole (pin) 20, or a defined distance at up to 50 yards on either side of direction markers 24 or 26 or hole (pin) 20, as will be explained below. The direction of the golf shot and the distance of the golf shot are measured simultaneously with a direction and distance marking means, generally illustrated in FIGS. 16 and 17 as 68.

The direction and distance marking means 68 of this invention comprises a 10 degree distance/direction gauge 70 which is illustrated in FIG. 17, and a 20 degree distance/direction gauge 72 which is illustrated in FIG. 16. The 10 degree distance/direction gauge 70 is provided to determine where the golf ball comes-to-rest for golf shots that are 10 degrees to the right or to the left of the point of aim, such as one of the direction markers 24 or 26 or the hole (pin) 20. The 20 degrees distance/-direction gauge 72 is provided to determine where the golf ball comes-to-rest for shots that are 20 degrees to the right or to the left of the point of aim. The gauges 70 and 72 are planar, pliable, thin sheet-like members, as exemplified in the exploded vertical sectional view of FIG. 19, and shaped generally as an isosceles triangle. Each gauge 70 and 72 has an apex 74 with a pair of equal length sides 76 and 78 and an arcuate end 80. Arcuate end 80 for gauge 72 is larger or longer than arcuate end 80 for gauge 70 because gauge 72 is a 20 degree gauge whereas gauge 70 is a 10 degree gauge. The facial planar structure of each gauge 70 and 72 between the respective sides 76 and 78 is provided with distance indicia 82 at preselected intervals on and along the facial planar structure to denote distance from the apex 74 of each gauge 70 and 72. The distance indicia 82 on each gauge 70 and 72 are yard markings, in part, in the form of a series of successive long lines 84 extending generally transverse, at regular intervals, across the entire facial planar structure from side 76 to side 78. The distance between successive pair of long lines 84 is equivalent to 10 yards. The distance indicia 82 are also, in part, in the form of a series of successive short lines 86 extending from the respective sides 76 and 78 and representing 5 yard increments between each short line 86 and its adjacent long line 84. The respective sides 76 or 78 of either gauge 70 or 72 may be used to measure the distance of a golf shot that has been indicated to be a straight shot from the SCHEDULE FOR GREEN DIRECTION DIE 64. A "straight shot" may be defined as a golf shot that lands along an imaginary straight line connecting from the point of where the golf ball was hit to and through the point [e.g. direction markers 24 or 26, hole (pin) 20, or a defined distance up to 50 yards on either side of direction markers 24 or 26, or hole (pin) 20 as explained below]where the golf shot was aimed. The distance for the straight shot along the imaginary line is determined by the number rolled by die 48 and from SCHEDULE FOR GREEN DISTANCE DIE IN YARDS 60.

Referring in detail now to the par 5 hole #5 in FIG. 20 to illustrate the plotting of a straight shot, assume a player selects the #1 wood to drive from the tee 16 on hole #5 and assume the golf shot is to be aimed at direction marker 24. The player rolls dice 48 and 50 and for the purposes of explanation generates respectively numbers "4" and "8", which from the SCHEDULE FOR GREEN DISTANCE DIE IN YARDS 60 and SCHEDULE FOR GREEN DIRECTION DIE 64 means that the golf shot traveled 260 yards and was a straight shot. The 10 degree distance/direction gauge 70 is positioned on the fairway 22 of hole #5 of game board 10 such that the apex 74 is registered with tee 16 and the side 76 is registered with the bench marker 24 as illustrated in FIG. 20. The equivalent distance of 260 yards is measured from apex 74 of gauge 70 along the side 76 in direction of the arrow A. The ball marker 38 is inserted into the game board 10 at the correct yardage point of the gauge 70, which for a 260 yard straight shot would be point B in FIG. 20. Point B represents where the golf shot landed after the player drove from the tee 16 on hole #5. For straight shots, side 78 of gauge 70 or sides 76 or 78 of 20 degree distance/direction gauge 72, may also be employed to measure the equivalent distance of 260 yards along the imaginary line extending from tee 16 through bench marker 24.

In the event that the numbers generated by dice 48 and 50 when rolled by a player are "2" and "3", respectively, then the golf shot with #1 wood from tee 16 on hole #5 traveled 240 yards and 10 degrees to the left of the bench marker 24 (see SCHEDULE FOR GREEN DISTANCE DIE IN YARDS 60 and SCHEDULE FOR GREEN DIRECTION DIE 64). As was indicated, it is assumed that the golf shot was aimed at the bench marker 24. To plot the #1 wood golf shot on hole #5 that traveled 240 yards from tee 16 and 10 degrees to the left of bench marker 24, 10 degree distance/direction gauge 70 is positioned again on the fairway 22 of hole #5 of game board 10 such that the apex 74 is registered with the tee 16 and the side 76 is registered with the bench marker 24, as illustrated in FIG. 20. The equivalent distance of 240 yards is measured from apex 74 of gauge 70 along the side 78 in direction of arrow C. When side 76 of gauge 70 is collimated with the bench marker 24, any point along side 78 represents a 10 degree to the left golf shot when the golf shot was aimed at the bench marker 24. The ball marker 38 is inserted into the game board 10 at the correct yardage point of the gauge 70, which for the 240 yards, 10 degrees to the left (of bench marker 24) #1 wood golf shot would be point D in FIG. 20. Point D represents where the golf ball rests after the player drove the golf ball from the tee 16 on hole #5 while aiming at bench marker 24. If the number generated by die 50 was "11" instead of "3", then the golf shot with the #1 wood traveled 240 yards and 10 degrees to the right of bench marker 24. To plot this golf shot, the 10 degree distance/direction gauge 70 would be positioned on the fairway 22 of hole #5 of game board 10 such that the apex 74 is registered with the tee 16 and the side 78 (and not side 76) is registered with the bench marker 24. The equivalent distance of 240 yards would be measured from apex 74 of gauge 70 along the side 76 in direction of arrow A. The ball marker 38 would be inserted into the game board 10 at the correct yardage point of 240 yards along side 76 of gauge 70. When side 78 of gauge 70 is registered with the bench marker 24 and when the apex 74 is registered with the tee 16, any point along side 76 represents a 10 degree to the right golf shot when the golf shot was aimed at the bench marker 24.

Referring in detail now to FIG. 21 (which is a partial plan view of hole #5 from FIG. 20) in order to illustrate the plotting of a second golf shot from point D where the golf ball rests after the #1 wood golf shot from tee 16 in FIG. 20, assume that the player selects the #3 wood to hit the golf ball from point D and assume that the second golf shot is to be aimed at direction marker 26. The player rolls dice 48 and 50 and generates respectively numbers "4" and "5". From the SCHEDULE FOR GREEN DISTANCE DIE IN YARDS 60 and SCHEDULE FOR GREEN DIRECTION DIE 64, it can be determined that the second gold shot traveled 230 yards at a direction of 20 degrees to the right of direction marker 26. The 20 degree distance/direction gauge 72 is positioned on the fairway 22 of the hole #5 of game board 10 such that the apex 74 is registered with point D and the side 78 is registered with the bench marker 26 as illustrated in FIG. 21. The equivalent distance of 230 yards is measured from apex 74 of gauge 72 along the side 76 in direction of arrow E. When side 78 of the 20 degree distance/direction gauge 72 is registered or aligned with the bench marker 26, any point along side 76 represents a 20 degrees to the right golf shot when the golf shot is aimed at the bench marker 26. The ball marker 38 is inserted into the game board 10 at the correct yardage point along side 76 of the gauge 72, which for the 230 yards, 20 degrees to the right (of bench marker 26 from point D) #3 wood golf shot would be point F in FIG. 21. Point F is in the rough 34 and represents where the golf ball rests after the player hit the golf ball from point D when aiming at bench marker 26. The third gold shot from point F would be appropriately aimed at the hole (pin) 20 on the green 18. If the number generated by die 50 had been "7" instead of "5", then side 76 of gauge 72 would have been aligned with the bench marker 26 and the equivalent distance of 230 yards would have been measured along side 78 to plot the golf shot from point D at a distance of 230 yards and 20 degrees to the left of bench marker 26. Had die 50 generated the number "1" or "4", the second gold shot from point D would have been a straight shot which could have been plotted at the appropriate distance of 230 yards along the imaginary line from point D through bench marker 26. The equivalent distance of 230 yards along the imaginary line may be measured with sides 76 or 78 of gauges 70 or 72.

Although 10 degree distance/direction gauge 70 and 20 degree distance/direction gauge 72 have been illustrated in the drawings and referred to in this disclosure, as the direction and distant marking means 68 of this invention, it should be understood that the invention is not to be limited to the use of a 10 degree distance/direction gauge 70 or a 20 degree distance/direction gauge 72 to plot simultaneously the determined distance and determined direction of a golf shot. Any suitable mechanism, device, or the like, for simultaneously plotting any determined distance and any determined direction golf shot are within the spirit and scope of this invention. Similarly, while gauge 70 and gauge 72 are for 10 degrees and 20 degrees, respectively, it should be understood that 10 degrees and 20 degrees are merely exemplary and the distance/direction gauges may be constructed to encompass any number of degrees, such as 5 degrees through 15 degrees, and 15 through 30 degrees, etc., as long as the direction indicia 66 in the SCHEDULE FOR GREEN DIRECTION DIE 64 has been modified accordingly. Thus, if a 25 degree distance/direction gauge (not shown in the drawings) is to be employed as a direction and distance marking means 68 of this invention, direction indicia 66 would have to be modified to contain and reflect "25 degrees left" and "25 degrees right."

Figure 2:
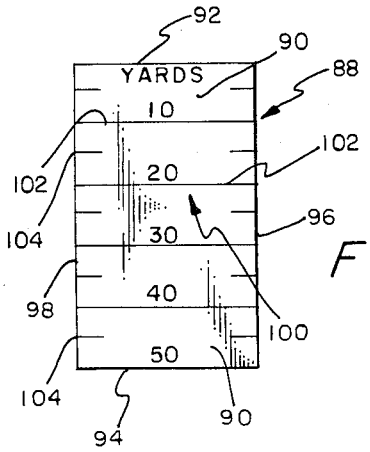
FIG. 2 is a top plan view of a distance marking means which may be used to facilitate the aiming and plotting of a golf shot.

Referring now to FIG. 2, there is seen a distance marking means, generally illustrated as 88, for facilitating the aiming of a golf shot as predetermined equivalent distance to either side of the point of aim, which for the purposes of the invention is direction markers 24 or 26 or the hole (pin) 20. The distance marking means 88 is preferably a planar, pliable, thin sheet member 90 as 10 degree distance/direction gauge 70 is represented to be in FIG. 19 and is generally rectangular in shape and having ends 90 and 94 and sides 96 and 98. The facial planar structure of the rectangular sheet member 90 is provided with distance indicia 100 at preselected intervals on and along the facial planar structure to denote equivalent distance from end 92. The distance indicia 100 are yard markings which in part are in the form of a series of successive long lines 102 generally transverse, at regular intervals across the entire facial planar structure between the sides, i.e. from side 96 to side 98 as illustrated in FIG. 2. Similar to the interval between long lines 84 for gauges 70 and 72, the distance between successive pairs of long lines 102 is equivalent to 10 yards. The distance indicia 100 are also, in part, in the form of a series of successive shot lines 104 which extend from the sides 96 and 98 as illustrated in FIG. 2, and represent 5 yard increments between each short line 104 and its adjacent long line 102. As indicated, the rectangular sheet member 90 may be used for golf shots aimed at a predetermined equivalent distance from one of the direction markers 24 or 26, or from the hole (pin) 20. The predetermined equivalent distance may be any suitable equivalent distance, such as 40 yards, 100 yards, etc. However, for the purposes of this invention, equivalent distance may be any equivalent distance up to 50 yards. The equivalent length of the rectrangular sheet member 90 may be any suitable equivalent length, depending on the equivalent distance away from one of the direction markers 24 or 26, or hole (pin) 20, the golf shot is to be aimed. Since for the purposes of this invention the equivalent distance is up to 50 yards, the equivalent length of the rectangular sheet member 90 is 50 yards. Thus, distance indicia 100 comprises yards markings extending from 0 yards up to and including the equivalent of 50 yards. The predetermined equivalent distance up to and including 50 yards is to be measured from one of the direction markers 24 or 26 or the hole (pin) 20, preferably at a direction essentially normal to an imaginary straight line connecting from the point where the golf ball rests and is to be played, through one of the direction markers 24 or 26 or the hole (pin) 20.

Referring in detail now to FIG. 22 to illustrate the use of the distance marking means 88 for facilitating the aiming of a golf shot a predetermined equivalent distance from a point of aim, a second golf shot is to be taken from point D where the golf ball rests after the #1 wood golf shot from tee 16 in FIG. 20. It is assumed that the player selects the #3 wood to strike the golf ball from point D, and it is assumed that the player is to aim the second golf shot a predetermined equivalent distance to the right of direction marker 26, which for the purposes of illustration only, will be 50 yards to the right of direction marker 26. The thin sheet member 90 of FIG. 2 is positioned on hole #5 of the game board 10 such that end 92 of the thin sheet member 90 is aligned with direction marker 26 as illustrated in FIG. 22. The equivalent distance of 50 yards is measured from the direction marker 26 with the thin sheet member 90 at a direction generally normal to the axis of the direction marker 26. Such a measurement with the thin sheet member 90 in FIG. 22 establishes a point of aim at approximately point G. The player rolls dice 48 and 50, and assumingly generates respectively numbers "1" and "7", which from the SCHEDULE FOR GREEN DISTANCE DIE IN YARDS 60 and SCHEDULE FOR GREEN DIRECTION DIE 64 means that the second golf shot from point D traveled 210 yards and 20 degrees to the left of the point of aim, point G. To plot the #3 wood second golf shot on hole #5 that traveled 210 yards from point D and 20 degrees to the left of point G, the the 20 degree distance/direction gauge 72 is disposed on the fairway 22 of hole #5 of game board 10 such that the apex 74 is registered with point D and side 76 is aligned or registered with point G, as illustrated in FIG. 22. The thin sheet member 90 may be left in place with the 20 degree distance/direction gauge 72 superimposed and positioned over the thin sheet member 90 as illustrated in FIG. 22, or, alternatively, the thin sheet member 90 may be removed prior to positioning the gauge 72 on the fairway 22 of hole #5 provided that point G has been labelled (or pinpointed by some means) to enable the alignment of side 76 with point G. The equivalent distance of 210 yards is measured from apex 74 of gauge 72 along side 78 in direction of arrow H. The ball marker 38 is inserted into the game board 10 at 210 yardage point of the gauge 72, which would be point I in FIG. 22. Point I represents where the golf ball rests after a 210 yard, 20 degrees to the right, golf shot from point D. The distance marking means 88 or the thin sheet member 90 may be similarly positioned against direction marker 24 or to hole (pin) 20 to establish a point of aim at a predetermined distance to either side of direction marker 24 or hole (pin) 20.

In the event that the golf shot from point D was aimed an equivalent distance of 20 yards to the right of direction marker 26, the thin sheet member 90 would preferably be left in place as depicted in FIG. 22 and FIG. 23, and the 20 degree distance/direction gauge 72 would be superimposed and positioned over the thin sheet member 90 such that the apex 74 is registered with point D and the side 76 of gauge 72 is aligned or registered with, and/or extends through, the mid-point MP of the 20 yard line 102 extending across the facial planar structure of the thin sheet member 90 from side 96 to side 98 (see FIG. 23). The side 76 of gauge 72 would be similarly aligned, registered, or the like, through the mid-points of other yard lines (such as 10 yard line 102 or 35 yard line 104) in the event that the golf shot was aimed an equivalent distance of yards represented by such other yard lines 102 or 104. Side 78 of gauge 72, as well as sides 76 and 78 of 10 degree distance/direction gauge 70, may be similarly deployed.

With reference again now to FIG. 15, a third source of information, also referred to as a SCHEDULE FOR RED PROBLEM DIE, is generally indicated as 106. Third source of information 106 includes a plurality of separate sets of travel indicia, each set generally illustrated as 108 and is preferably in column form as seen in FIG. 15. The plurality of separate sets of travel indicia 108 relate each of a plurality of problems or hazards comprising "in the rough" 110, "in fairway sand trap" 112, "behind a tree" 114, and "under a tree" 116. These hazards results from the player's golf ball or the ball marker 38 landing or being spotted in the rough 34, in the sand trap(s) 30, behind a tree 28, in response to the length of travel of a player's golf ball according to the first number indicia 62 obtained from the first source of information 60 and from the direction of travel of the player's golf ball according to direction indicia 66 obtained from the second source of information 64. "Behind a tree" 28 may be defined as any golf shot hit where a part of an outline of tree foliage pictured on the game boards 10, 12 and 14 is between a point where the golf shot is to be taken and the intended direction of the golf shot. "Under a tree" 28 is any golf shot made from within the pictorial outline of tree foliage on the game boards 10, 12 and 14. Travel indicia 108 represents the length of travel in yards of a player's golf ball from one of the plurality of problems or hazards (i.e. "in the rough" , "in fairway sand trap", "behind a tree", or "under a tree") according to a number generated by the third chance means 52, which, as was indicated, is preferably die 54. By way of example only: a player elects a five-iron to shoot a golf ball from the rough 34. Dice 48, 50 and 54 are all rolled simultaneously to generate respectively the numbers "5", "7" and "1". The golf shot traveled 160 yards (170 yards from SCHEDULE FOR GREEN DISTANCE DIE IN YARDS 60 minus the 10 yards lost from reading "Lost 10 yards" in SCHEDULE FOR RED PROBLEM DIE 106) at a direction of 20 degrees to left of point of aim, which direction was determined from SCHEDULE FOR GREEN DIRECTION DIE 64.

The golf game of this invention also comprises a fourth source of information (also referred to as SCHEDULE FOR GREENSIDE TRAP SHOTS & PUTTS), generally illustrated as 118 in FIG. 15. The fourth source of information 118 comprises short-putt indicia, generally illustrated as 120, long-put indicia, generally illustrated as 122, and greenside sand trap indicia, generally illustrated as 124. The SCHEDULE FOR GREENSIDE TRAP SHOTS & PUTTS 118 determines the results for golf shots from the greenside sand traps 33 and for putts on the green 18. Shortputt indicia 120 is listed in column formation under "Short Putts" and indicates the number of putts required (i.e. either 1 putt or 2 putts) to putt the player's ball into the hole (pin) 20 of each green 18 from within the short-putt area 17 according to a number generated by die 58 (i.e. the fourth chance means 56) or die 48 (i.e. the first chance means 44) in the event the die 58—fourth chance means 56 is omitted. Long-putt indicia 122 is also listed in column formation under "Long Putts" and indicates the number of putts required (i.e. 1, 2 or 3 putts) to putt the player's ball into the hole (pin) 20 of each green 18 from within the long-putt area 19 according to a number generated by die 58 -fourth chance means 56 or die 48—first chance means 44. Greenside sand trap indicia 124 is listed under "Greenside Sand Trap" in column formation and indicates one of the following according to a number generated by die 58—fourth chance means 56 or or die 48—first chance means 44: "To Long Putt Area", "To Shot Putt Area", "To 'Gimme Putt'", and "Still in Trap". The greenside sand trap indicia 124 thus indicates the location where a player's ball is to land from the greenside sand trap 33 according to a number generated by the die 58—fourth chance means 56 or die 48—first chance means 44. For the purposes of simplification, it will be assumed that the die 58—fourth chance means 56 is omitted, and when putts and greenside sand trap-shots are to be taken, die 48—first chance means 44 will be employed in place of die 58—fourth chance means 56 to randomly generate a number to determine the results of golf shots from greenside sand traps 33 and for putts on the green 18.

An official score card, generally illustrated as 140 in FIG. 14, is provided to each player in order for each player to keep score as the golf game of this invention is played. Each score card 140 has a hole column 142 to identify the particular golf hole being played, a yards column 144 to identify the length in yards of each golf hole from tee 16 to hole (pin) 20, and a par column 146 to identify par for each golf hole. A blank space 148 is provided for each player to enter his or her name, followed by the number of golf strokes taken by the respective player for each respective golf hole.

EXEMPLARY RULES OF PLAY

In describing the rules of play, the fourth chance means 56 or die 58 will be omitted, and when it comes time to generate a number of from one to six to determine the results of a golf shot from a greenside sand trap 33 or a putt on a green 18, first chance means 44 or die 48 will be employed to generate such a number. After the number is generated, the fourth source of information 118 (or the SCHEDULE FOR GREENSIDE TRAP SHOTS & PUTTS 118) is used to determined the results of the golf shot according to the number generated by the die 48. While, as was previously mentioned, the color of dice 48, 50 and 54 may be any color, the color of these dice for explaining the rules of play will be as follows: die 48 is green; die 50 is green; and die 54 is red.

The green six-sided die 48 is used to determine the distance a golf shot travels depending on club selection. As indicated in the first source of information 60, club selection ranges from 1, 3, and 5 woods; 3, 4, 5, 6, 7, 8, and 9 irons, pitching wedge, sand wedge, plus pitch/-chip shot of long, medium, and short distance. The SCHEDULE FOR GREEN DISTANCE DIE IN YARDS 60 is to be referred to for distance or yardage of a particular golf shot. Die 48 also determines the result of a gold shot from a greenside sand trap 33 or the number of putts required once the golf ball is on the green 18.

The green twelve-sided die 50 is used to determine the direction of a golf shot travels, either straight, 10 degrees right or left, or 20 degrees right or left. If a "12" is rolled on the green twelve-sided die 50, it allows the possibility of a shot being "holed" (for example: a hole in one on a par 3) provided the shot is within the small circle 21 on the green 18.

The red six-sided die 54 is only used when a problem shot is hit from the rough 34, a fairway sand trap 30, from behind a tree 28, or from under a tree 28. Fairway sand traps 30 are any sand traps more than 50 yards from the green 18 in either the fairway 22 or the rough 34. As was indicated previously, rough 34 is anywhere outside the fairway 22 being played, including the islands in the lakes of water 32. "Behind the tree" is any golf shot hit when a tree 28 is between the point where the golf shot is hit and the intended direction of the shot; and "under a tree" is any golf shot made from within the outline of tree foliage on the game boards 10, 12 and 14. For any case where two or more problem situations occur simultaneously, the travel indicia 108 relating to the occurring problem that is farthest to the right in SCHEDULE FOR RED PROBLEM DIE 106 applies. For example, a golf ball in the rough 34 and under a tree 28, the travel indicia 108 relating to "under a tree" 116 would be employed. Similarly, a golf ball in a fairway sand trap 30 and behind a tree 28, the travel indicia 108 relating to "behind a tree" 114 would be used.

For every golf shot taken until or before, the golf ball is either in a greenside sand trap 33 or in the green 18, the green six-sided distance die 48 and the green twelve-sided direction die 50 are used. Both dice 48 and 50 are rolled together or simultaneously. For problem golf shots from the rough 54, or fairway sand traps 30, or behind a tree 28, or from under a tree 28, the red problem die 54 is added and the three dice 48, 50 and 54 are all rolled together or simultaneously. For golf shots from a greenside sand trap 33 or putts on the green 18, only the green six-sided die 48 is rolled and the results determined by the schedule for these type of golf shots, i.e. the SCHEDULE FOR GREENSIDE TRAP SHOTS & PUTTS 118.

All par 4 and par 5 holes have the direction marker 24 in the fairway 22 at an equivalent distance of 250 yards from the tee 16. All shots from the tee 16 are assumed to be aimed at the front pointer of the direction marker 24 unless the player declares that he or she is aiming the golf shot some number of yards either right or left of the direction marker 24, up to a maximum of 50 yards since for the purposes of this invention, it is assumed that the thin sheet member 90 possesses the equivalent distance of up to 50 yards from end 92 to end 94. All par 5 holes have the second direction marker 26 down the fairway 22 between 170 yards and 200 yards from the first direction marker 24. It is assumed that a player's second shot on a par five hole is aimed at second direction marker 26 unless the player declares otherwise. Players are allowed to aim their second shot on par 5 holes at the green 18 should they choose to do so.

Golf shots from the tee 16 on par 3 holes and second shots on par 4 and par 5 holes aimed at the green 18 are assumed to be aimed at the pin [i.e. the hole (pin) 20] unless the player declares he or she is aiming the shot either right or left of the hole (pin) 20 by so many yards, up to a maximum of 50 yards. As was previously indicated, the 50 yard thin sheet member 90 is provided to determine the point of reference for golf shots aimed to the right or left of a direction marker 24 or 26 or the hole (pin) 20. The explanation of how the thin sheet member 90 is used has been previously mentioned, more specifically when FIG. 22 and FIG. 23 was explained or referred to in detail. The 10 degree distance/direction gauge 70 is provided to determine where the golf ball comes-to-rest for golf shots that are 10 degrees right or left of the point of aim and gold shots that are straight. The 20 degree distance/direction gauge 72 is provided to determine where the golf ball comes-to-rest for golf shots that are 20 degrees right or left. The explanation of how distance/direction gauges 70 and 72 are employed in the play of the golf game was previously presented above, more particularly when FIGS. 20, 21 and 22 were preferred to in detail.

Golf shots coming-to-rest outside the circle 23 anywhere on the green 18, the green six-sided die 48 (only) is rolled and the long-putt indicia 122 of SCHEDULE FOR GREENSIDE TRAP SHOTS & PUTTS 118 is used to determined the number of putts required to complete the hole. For shots coming-to-rest inside the circle 23 but outside the circle 21 on the green 18, the green six-sided die 48 (only) is rolled, and the short putt indicia 120 of SCHEDULE FOR GREENSIDE TRAP SHOTS & PUTTS 118 is used to determine the number of putts required to complete the hole. When any golf shot comes-to-rest within the circle 21 on the green 18, the next shot is a "gimme" (i.e. only one putt added to the score for the hole). The only way a shot landing within the circle 21 can be counted as going in the hole is as mentioned above, that the green direction die 50 must indicate the number "12".

Normal rules of golf apply where practical, except where changes are required to accommodate the board game of this invention. "Out-of-bounds" is any golf shot that would come-to-rest off the board 10, 12 or 14. The penalty for a golf ball hit out-of-bounds is loss of stroke and distance plus one penalty stroke. For example: if a ball is hit out-of-bounds on a tee shot, the next shot is from the tee 16, hitting three. Any golf ball coming-to-rest within the water 32 is in a water hazard. The golf ball must be dropped (i.e. placed) at least the equivalent distance of five yards behind the line-of-flight entry into the water hazard. It should be recognized that for lateral hazards, balls dropped five yards from point of entry could end up less than five yards from the hazard at a 90 degree angle. The #1 wood club (or driver) can only be used for golf shots from tee 16. All other clubs can be used anywhere on the golf course.

The order for teeing off on the first hole is determined by each person rolling the green six-sided die 48 with the lowest number teeing off first and so on. For subsequent tee boxes the player scoring the lowest on the last hole played will "have the honors" and tee off first and so on. For shots in the fairway 22 or rough 34, the player furthest away from the hole hits first. Players are allowed to use the distance/direction gauges 70 or 72, or the 50 yard thin sheet member 90, at any time to measure the required distance or check direction prior to taking their shot. Shots that come to rest on bridges should be moved to nearest relief area no closer to the hole, without penalty.

The golf games of this invention is designed to simulate the actual game of gold as closely as practical. As in actual golf, the object is to "shoot" a low score; hopefully, par 72 or below. Unlike actual golf, however, all players have equal ability "swinging the clubs" and only selection of clubs, choice of direction, and luck will make the difference in scores. The golf game of this invention is played on a specially designed 18 hole golf course laid out on the three double-sided game boards 10, 12 and 14. Any resemblance between golf holes used in this game and actual holes existing on any golf course is just a coincidence.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A golf game comprising at least one game board means carrying a pictorial configuration of a multi-hole golf course including appropriate pictorial representations of a tee, a green with a boundary and distant from said tee, a hole on each green, a fairway generally extending between said tee and said green, and a plurality of hazards positioned adjacent to said fairway and to said green;

at least one ball marker means signifying a golf ball of a player and adapted to be moved and positioned on the game board by a player after a golf shot;

a first chance means for manipulation by a player for randomly generating a number;

a first source of information means including a plurality of sets of first number indicia thereon relating to each of a plurality of clubs arbitrarily chosen by a player prior to manipulation of said first chance means, said first number indicia of each of said sets represents a length of travel of a player's golf ball when using a particular club according to a number generated by the first chance means;

a second chance means for manipulation by a player for randomly generating a second number;

a second source of information means comprising direction indicia for signifying the direction of travel of the player's golf ball according to the number generated in response to manipulation of the second chance means;

at least one direction and distance marking means for facilitating the plotting of a golf shot with the ball marker means from the length of travel of a player's golf ball according to the first number indicia obtained from the first source of information means and from the direction of travel of the player's golf ball according to direction indicia obtained from the second source of information means; and a distance marking means for facilitating the aiming of a golf shot a predetermined equivalent distance to either side of a point of aim.

2. The golf game of claim 1 additionally comprising a third chance means for manipulation by a player for randomly generating a third number.

3. The golf game of claim 2 additionally comprising a third source of information means including separate sets of travel indicia relating to a plurality of problem conditions representing at least one of the hazards pictorially represented on the game board means and resulting from the ball marker of a player being in a problem condition after being plotted in response to the length of travel of a player's golf ball according to the first number indicia obtained from the first source of information means and from the direction of travel of the player's golf ball according to direction indicia obtained from the second source of information means.

4. The golf game of claim 3 wherein each green comprises a short-putt area that is pictorially represented on said green.

5. The gold game of claim 4 wherein each green comprises a long-putt area that is pictorially represented on said green.

6. The golf game of claim 5 wherein each game board means comprises at least one greenside sand trap pictorially represented in proximity to at least one green, and each green comprises a gimme-putt area that is pictorially represented on said green.

7. The golf game of claim 6 wherein said gimme-putt area comprises an area of a first circle pictorially represented on at least one green and centered on said hole of said green, said short-putt area comprises an area outside the first circle and with a second circle pictorially represented on at least one green and centered on said hole of said green and concentric with said first circle, said long-putt area comprises an area outside the second circle and within the boundary of said green and pictorially represented on at least one green.

8. The golf game of claim 7 additionally comprising a fourth source of information means comprising short-putt indicia, longputt indicia, and greenside sand trap indicia.

9. The golf game of claim 1 wherein said second chance means comprises a die having at least seven sides wherein each side represents and includes the second number which may be generated; said first chance means comprises a six-sided die and said third chance means comprises a six-sided die.

10. The golf game of claim 1 wherein said game board means comprises a pictorial representation of at least one fairway having disposed therein at least one first direction marker means distant from the tee.

11. The golf game of claim 10 wherein said game board means comprises said pictorial representation of said at least one fairway having disposed therein at least one second direction marker means distant from said first direction marker means.

12. A method for playing a gold game on at least one game board means carrying a pictorial configuration of a multi-hole golf course including appropriate pictorial representations of a tee, a green with a boundary and distant from said tee, a hole on each green, a fairway generally extending between said tee and said green, and a plurality of hazards positioned adjacent to said fairway and to said green, said method comprising the steps of:

(a) selecting a golf club in order to take a first golf shot from the tee;

(b) manipulating simultaneously a first chance means for randomly generating a first number which is used to determine the distance of the golf and a second chance means for randomly generating a second number which is used to determine the direction of the golf shot;

(c) determining the distance of the golf shot from a first source of information means according to the golf club selected and the first number generated by the first chance means;

(d) determining the direction of the golf shot from a second source of information means according to the second number generated by the second chance means; and (e) plotting the golf shot on the game board means; said plotting comprises (f) aligning a point on a direction and distance marker means with the tee and aligning further a straight edge border of the direction and distance marker means with a first direction marker means which distinguishably defines a first single point of aim on a fairway, said direction and distance marker means having indicia representing the distance of travel of the golf shot from the tee determined from the first source of information means and a configuration representing the direction of travel of the golf shot from the tee determined from the second source of information means;

(g) locating and marking on the game board means with the direction and distance marker means a first golf shot location from the distance of travel and direction of travel of the first golf shot;

(h) selecting a golf club in order to take a second golf shot from the first golf shot location;

(i) manipulating simultaneously for a second time the first chance means for randomly generating a second first number which is used to determine the distance of the second golf shot and the second chance means for randomly generating a second second number which is used to determine the direction of the second golf shot;

(j) determining the distance of the second gold shot from the first source of information means according to the golf club selected and the second first number generated by the first chance means;

(k) determining the direction of the second golf shot from the second source of information means according to the second second number generated by the second chance means;

(l) aligning a point on a direction and distance marker means with the first golf shot location and a straight edge border of the direction and distance marker means of this step (1) with a second direction marker means which distinguishably defines a second single point of aim on the fairway of step (f); and (m) locating and marking on the game board means with the direction and distance marker means of step (1) a second golf shot location from the distance of travel and direction of travel of the second golf shot.

13. The method of claim 12 additionally comprising manipulating a third chance means simultaneously with said first chance means and said second chance means in order to randomly generate a third number.

14. The method of claim 13 additionally comprising determining the distance of travel of the golf shot from a problem condition by a third source of information means.

15. The method of claim 14 additionally comprising manipulating said first chance means again to determine the number of putts required from a fourth source of information means.

16. A method for playing a golf game on at least one game board means carrying a pictorial configuration of a multi-hole golf course including appropriate pictorial representations of a tee, a green with a boundary and distant from said tee, a hole on each green, a fairway generally extending between said tee and said green, and a plurality of hazards positioned adjacent to said fairway and to said green, said method comprising the steps of:

(a) selecting a golf club in order to take a golf shot from a predetermined location;

(b) manipulating simultaneously a first chance means for randomly generating a first number which is used to determine the distance of the gold shot and a second chance means for randomly generating a second number which is used to determine the direction of the golf shot;

(c) determining the distance of the golf shot from a first source of information means according to the golf club selected and the first number generated by the first chance means;

(d) determining the direction of the golf shot from a second source of information means according to the second number generated by the second chance means;

(e) aligning a distance marking means with a direction marker means in a fairway;

(f) aligning a direction and distance marker means against the distance marking means of steps (e); and (g) plotting the golf shot on the game board means.

17. The method of claim 16 wherein said aligning step (f) comprises aligning a straight edge border of the direction and distance maker means with a mid-point of a distance line extending across a facial planar structure of the distance marking means of step (e).

18. The method of claim 16 additionally comprising manipulating a third chance means simultaneously with said first chance means and said second chance means in order to randomly generate a third number.

19. The method of claim 18 additionally comprising determining the distance of travel of the golf shot from a problem condition by a third source of information means.

20. The method of claim 19 additionally comprising manipulating said first chance means again to determine the number of putts required from a fourth source of information means.

* * * * *